US008289249B2

(12) United States Patent
Lee

(10) Patent No.: US 8,289,249 B2
(45) Date of Patent: Oct. 16, 2012

(54) LIGHT BLOCKING DISPLAY DEVICE OF ELECTRIC FIELD DRIVING TYPE

(75) Inventor: Chun-Hyuk Lee, Seoul (KR)

(73) Assignee: Dongjin Semichem Co., Ltd., Incheon (KR)

( * ) Notice: Subject to any disclaimer, the term of this patent is extended or adjusted under 35 U.S.C. 154(b) by 858 days.

(21) Appl. No.: 11/817,844

(22) PCT Filed: Mar. 10, 2006

(86) PCT No.: PCT/KR2006/000864

§ 371 (c)(1),
(2), (4) Date: Sep. 5, 2007

(87) PCT Pub. No.: WO2006/096034

PCT Pub. Date: Sep. 14, 2006

(65) Prior Publication Data

US 2009/0009445 A1 Jan. 8, 2009

(30) Foreign Application Priority Data

Mar. 11, 2005 (KR) ..... 10-2005-0020503

(51) Int. Cl.
*G09G 3/34* (2006.01)

(52) U.S. Cl. ..... 345/85; 345/86; 345/107; 345/108; 359/230

(58) Field of Classification Search ..... 345/85, 345/7, 8, 9, 107, 84, 86, 108–111; 359/230, 359/227, 296

See application file for complete search history.

(56) References Cited

U.S. PATENT DOCUMENTS

| | | | | |
|---|---|---|---|---|
| 6,052,287 | A * | 4/2000 | Palmer et al. | 361/767 |
| 7,427,978 | B2 * | 9/2008 | Darty | 345/107 |
| 2002/0063816 | A1 * | 5/2002 | Nakamura et al. | 349/65 |
| 2003/0025985 | A1 | 2/2003 | Katase | |
| 2004/0041521 | A1 * | 3/2004 | Mandler et al. | 313/512 |
| 2006/0203327 | A1 * | 9/2006 | Yasuda | 359/296 |

FOREIGN PATENT DOCUMENTS

| | | | |
|---|---|---|---|
| CN | 1402069 | A | 3/2003 |
| EP | 1 482 359 | A1 | 12/2004 |
| JP | 62-99727 | A | 10/1994 |
| JP | 2000-312319 | A | 11/2000 |

(Continued)

OTHER PUBLICATIONS

European Search Report dated May 19, 2010 EP No. 06716314.7.

(Continued)

*Primary Examiner* — Lun-Yi Lao
*Assistant Examiner* — Olga Merkoulova
(74) *Attorney, Agent, or Firm* — Gifford, Krass, Sprinkle, Anderson & Citkowski, P.C.

(57) ABSTRACT

Provided is a light blocking display device of an electric field driving type, including a barrier layer (150) including a plurality of driving holes (151) and having a first surface and a second surface, driving bodies (101) which are inserted into the driving holes (151) and have charges, a pixel electrode (120) formed on the first surface of the barrier layer (150), and a common electrode (22) formed on the second surface of the barrier layer (150), wherein the area of a cross section parallel to the first and second surfaces of the driving holes (151) is gradually changed from the first surface to the second surface.

32 Claims, 7 Drawing Sheets

FOREIGN PATENT DOCUMENTS

| | | | | |
|---|---|---|---|---|
| JP | 2000312319 | A | * | 11/2000 |
| JP | 2001-174853 | A | | 6/2001 |
| JP | 2001-282143 | | | 10/2001 |
| JP | 2002-513169 | A | | 5/2002 |
| JP | 2003-029306 | A | | 1/2003 |
| JP | 2003-502695 | A | | 1/2003 |
| JP | 2005-49657 | | | 2/2005 |
| JP | 2002-139749 | A | | 5/2007 |
| TW | 1238308 | | | 8/2005 |
| WO | WO 99/56171 | | | 11/1999 |
| WO | WO 00/77570 | | | 12/2000 |
| WO | WO-02/01288 | A1 | | 1/2002 |
| WO | WO-2004/046806 | A1 | | 6/2004 |
| WO | WO-2005/010605 | | | 2/2005 |
| WO | WO-2005/010605 | A1 | | 2/2005 |
| WO | WO 2005/010605 | A1 | * | 2/2005 |

OTHER PUBLICATIONS

Taiwanese Office Action dated May 23, 2012 relating to Taiwanese Patent Application No. 95108284.

Japanese Office Action dated Jun. 5, 2012 relating to JP Patent Application No. 2008-500637.

* cited by examiner

[Fig. 1]
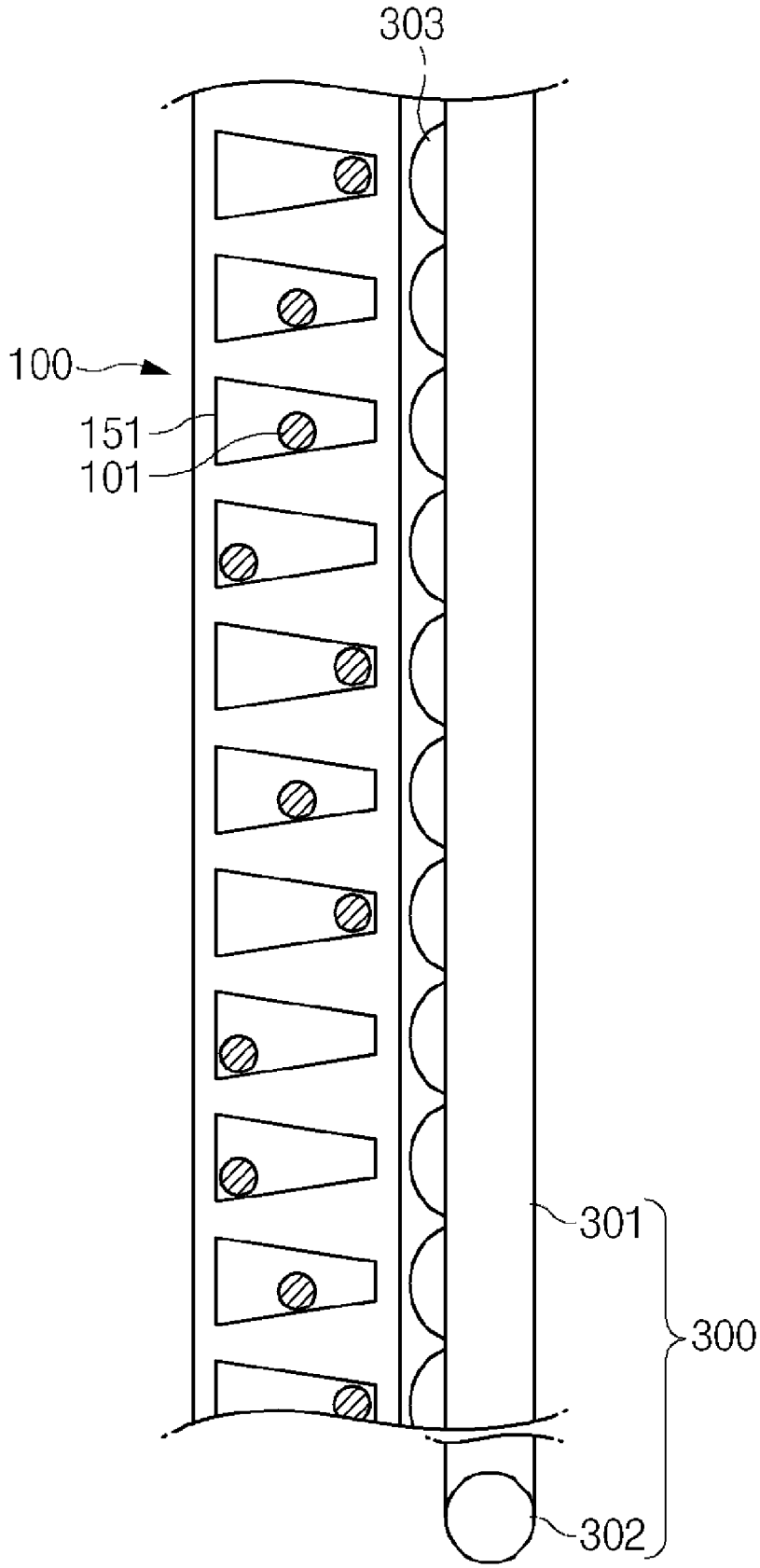

[Fig. 2]
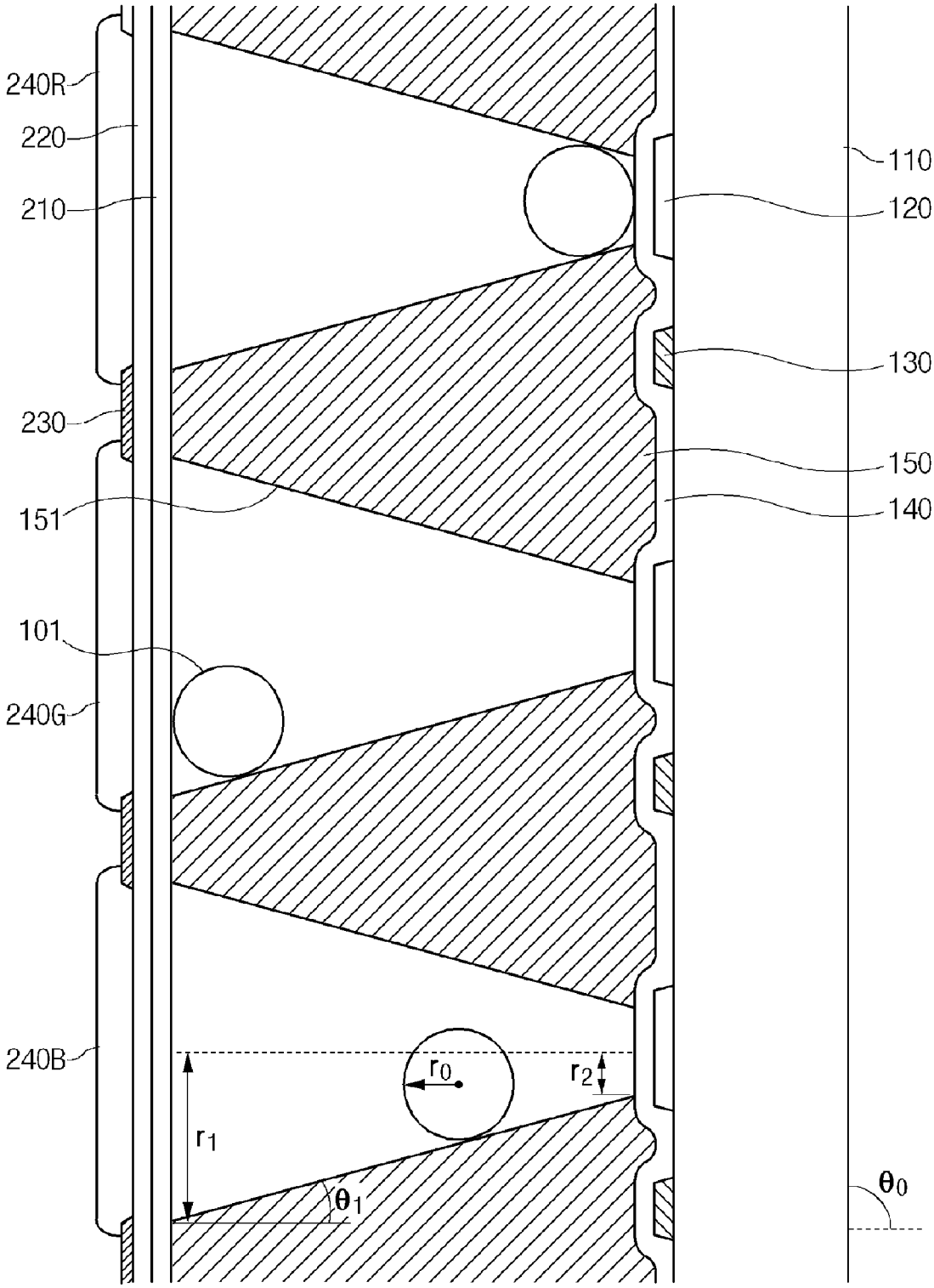

[Fig. 3]
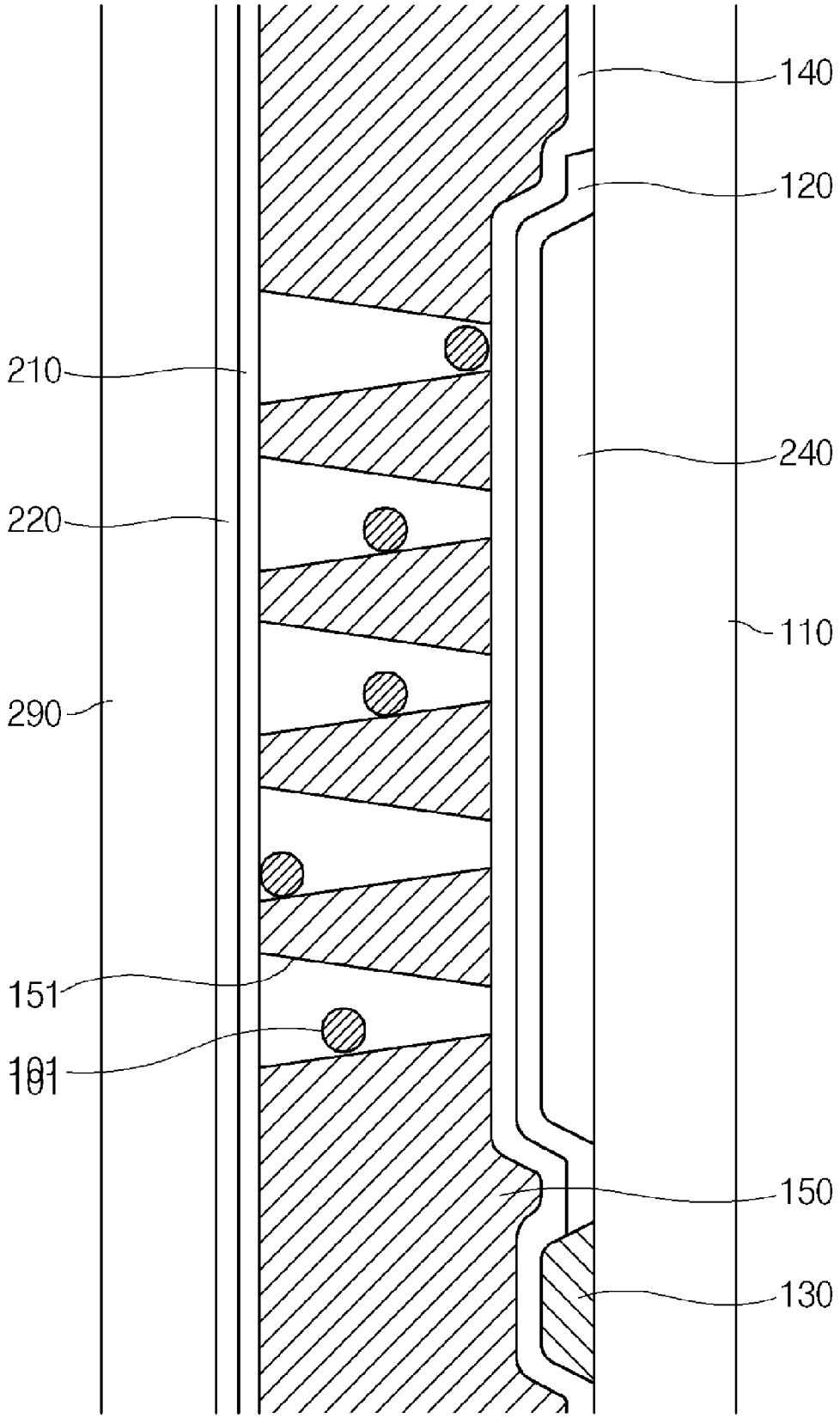

[Fig. 4]
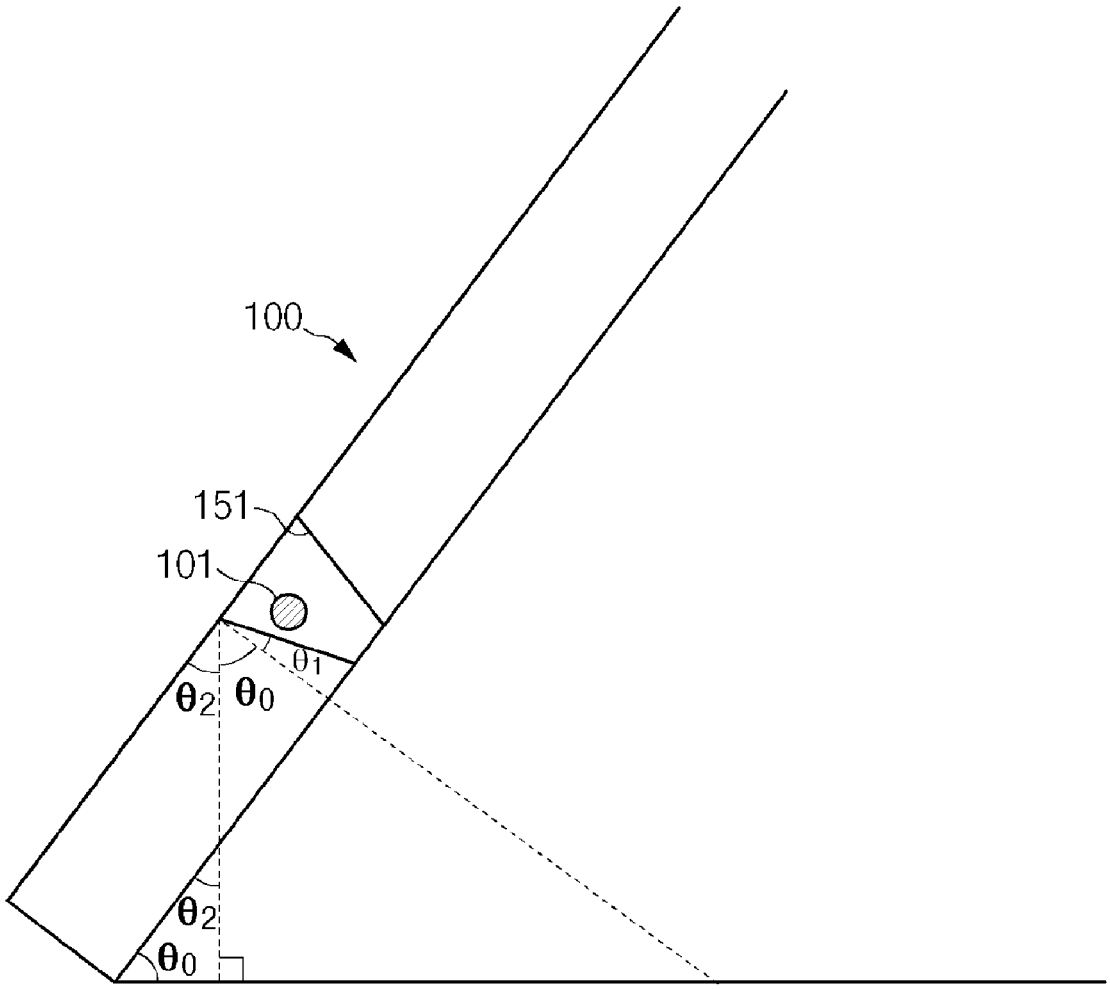
[Fig. 5]
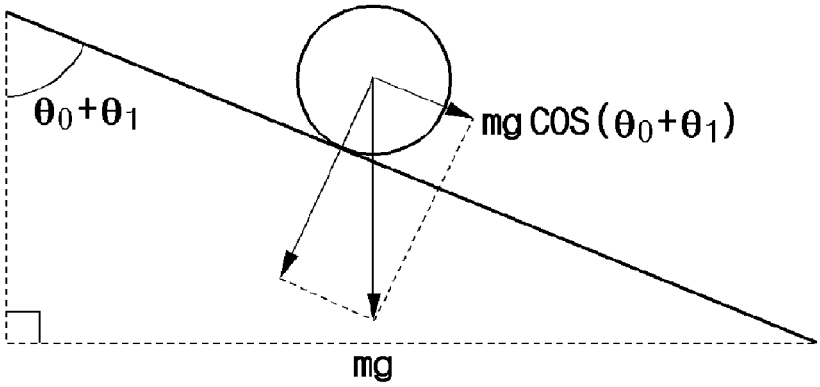

[Fig. 6]
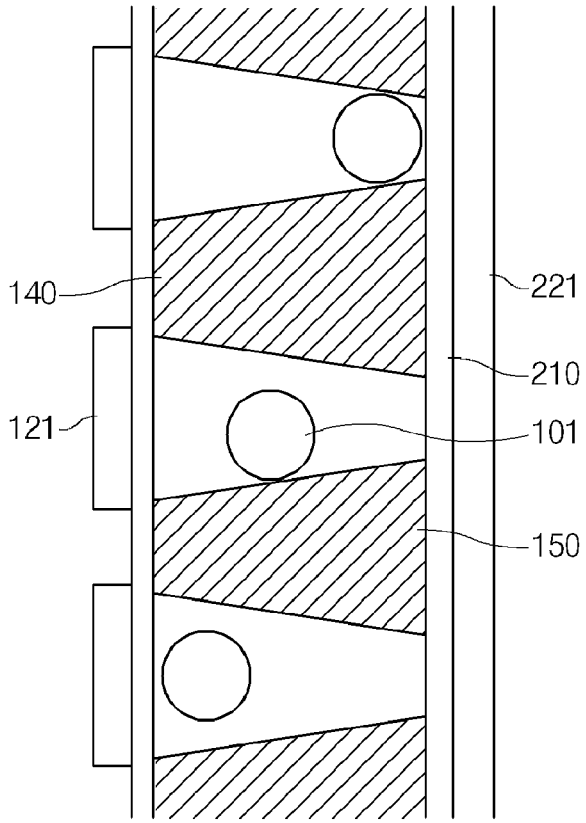
[Fig. 7]
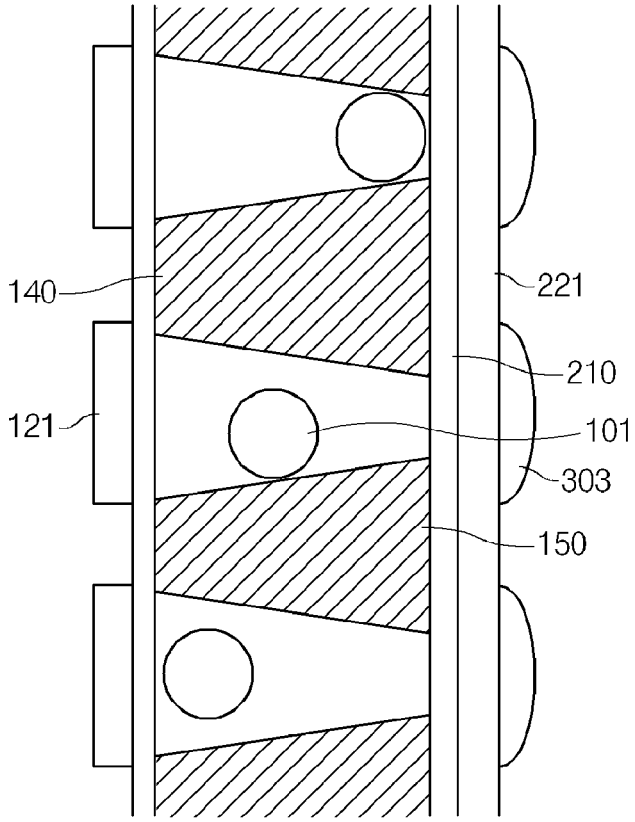

[Fig. 8]
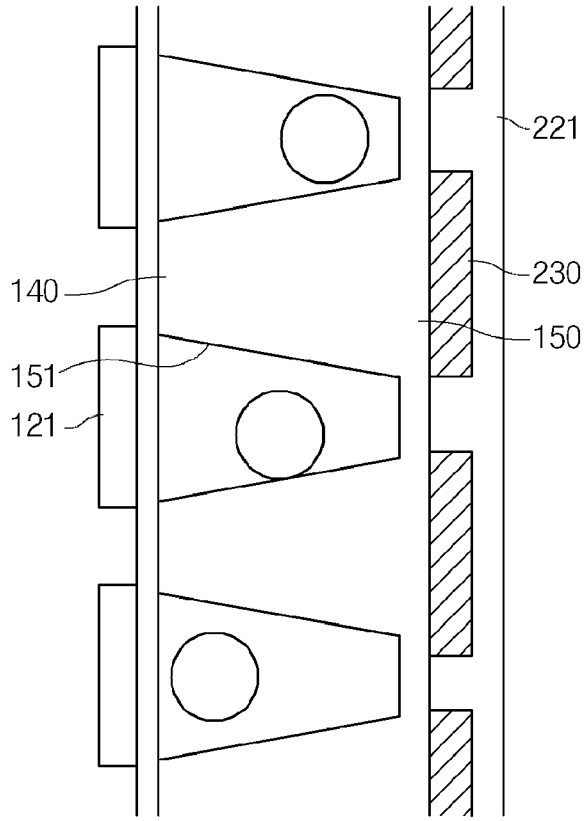
[Fig. 9]
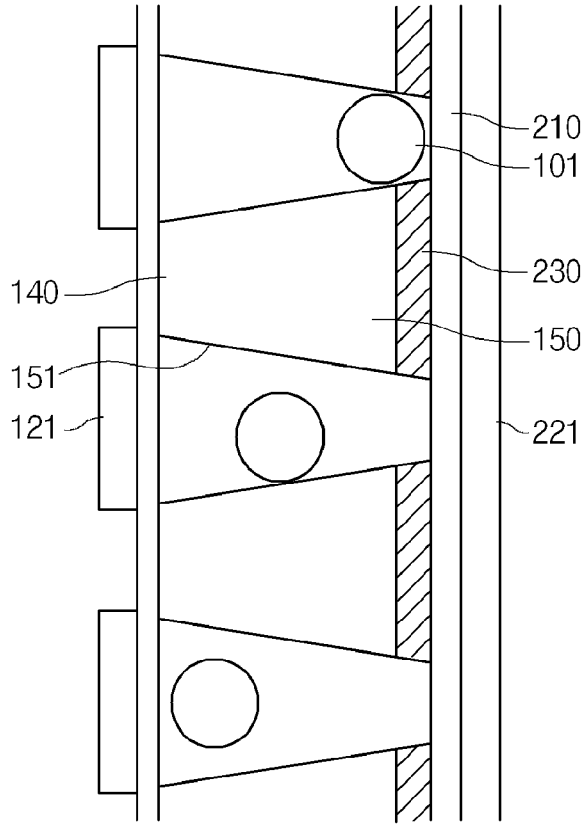

[Fig. 10]
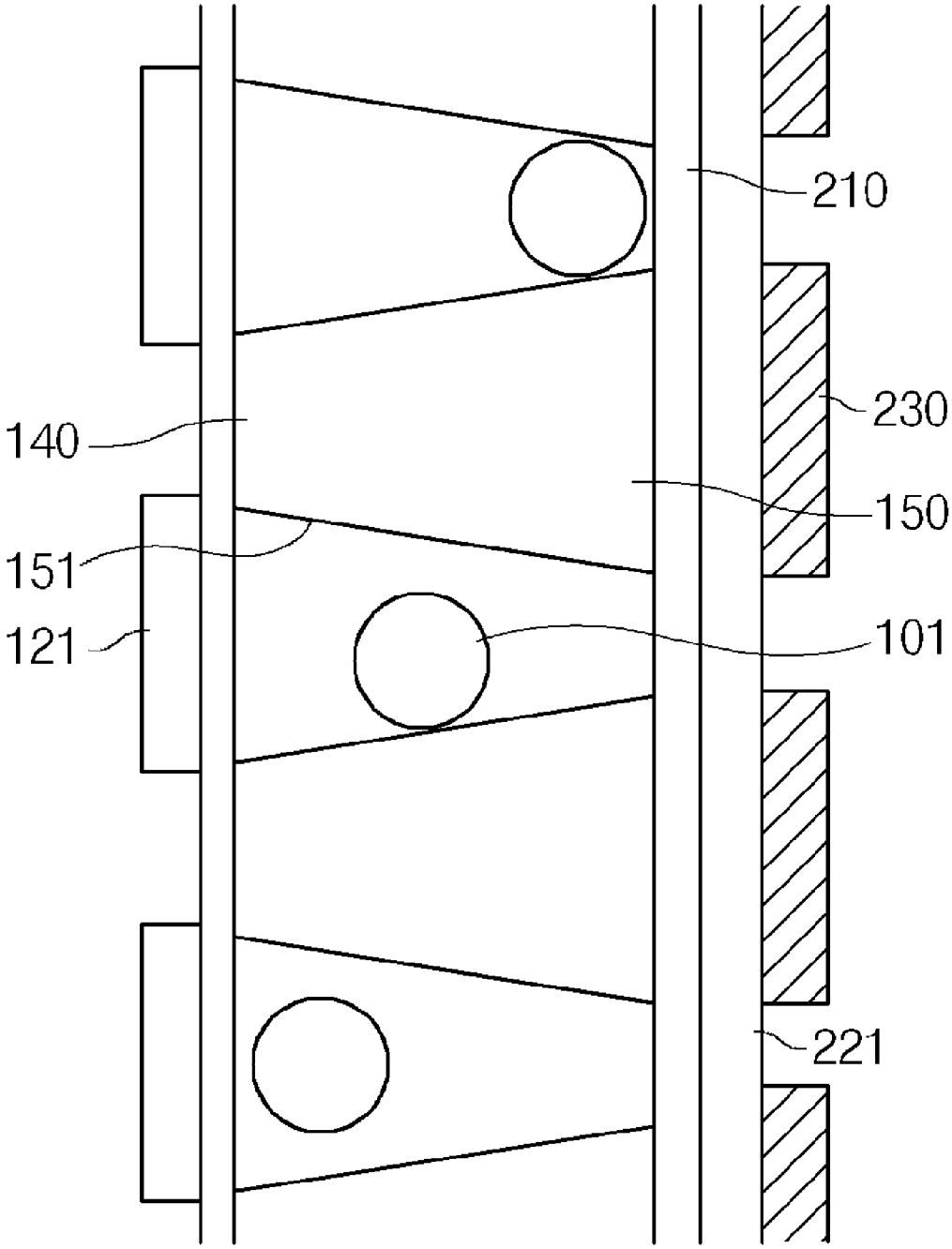

LIGHT BLOCKING DISPLAY DEVICE OF ELECTRIC FIELD DRIVING TYPE

TECHNICAL FIELD

The present invention relates to a flat display device, and more particularly, to a light blocking display device of an electric field driving type.

BACKGROUND ART

As a flat display device, there are a liquid crystal display (LCD), a plasma display panel (PDP), an organic electroluminescence display (OLED), a field effect display (FED), and an electrophoretic display device. Among them, the LCD is widely used in a monitor or a television set, and the plasma display panel is widely used in a large-screen television set. The organic electroluminescence display is used in a small scaled display device such an LCD of a mobile phone. Research into applying the organic electroluminescence display to a medium or large scaled display device is actively ongoing. Further, research into applying the field effect display or the electrophoretic display device to a monitor, a television set, or an electronic paper is ongoing.

DISCLOSURE OF INVENTION

Technical Problem

However, the display devices which have been widely known up to now have respective problems. For example, the LCD has a narrow viewing angle, a low response speed, and a high manufacturing cost. In the plasma display device, it is difficult to make a pixel having a size less than a predetermined size. In addition, power consumption is high, and a large amount of heat is generated.

Technical Solution

The present invention is contrived to solve the above-mentioned problems, and an object of the present invention is to provide a novel flat display device without problems of conventional flat display devices.

According to an aspect of the present invention, there is provided a light blocking display device of an electric field driving type, including a barrier layer including a plurality of driving holes and having a first surface and a second surface; driving bodies which are inserted into the driving holes and have charges; a pixel electrode formed on the first surface of the barrier layer; and a common electrode formed on the second surface of the barrier layer, wherein the area of a cross section parallel to the first and second surfaces of the driving holes is gradually changed from the first surface to the second surface.

In the aforementioned aspect of the present invention, the light blocking display device may further include a first insulating layer formed between the first surface of the barrier layer and the pixel electrode; and a second insulating layer formed between the second surface of the barrier layer and the common electrode. At least one of inert gas, nitrogen, and dried air is filled in the driving holes. Switching elements formed on the first surface of the barrier layer may be further included, and the switching elements may be connected to the respective pixel electrodes to control voltages applied to the respective pixel electrodes. Each of the switching elements may include a thin film transistor.

Each of the driving bodies may have a spherical shape and made of an opaque material. Each of the driving holes may have a truncated cone shape. The area of a cross section passing through a center of each of the driving bodies may be greater than the cross section of each of the driving holes.

The barrier layer may be black. The barrier layer may be formed by exposing and developing a photosensitive layer containing black pigment using a mask. The light blocking display device may further include a light shielding layer formed on any one of the first surface and the second surface of the barrier layer.

The light blocking display device may further include an insulating substrate provided on at least one of an outer surface of the pixel electrode and an outer surface of the common electrode. The insulating substrate may include a first insulating substrate provided on the outer surface of the pixel electrode and a second substrate provided on the outer surface of the common electrode.

The pixel electrode may overlap with the plurality of driving holes. The area of the cross section parallel to the first and second surfaces of the barrier layer may gradually increase or decrease while the area is changed from the first surface to the second surface.

The light blocking display device may further include a color filter formed on one of an outer surface of the pixel electrode and an outer surface of the common electrode. The light blocking display device may further include an insulating substrate provided on the outer surface of the pixel electrode, and the color filter may be disposed between the pixel electrode and the insulating substrate.

The pixel electrode and the common electrode may be made of a transparent conductive material. Examples of the transparent conductive material include indium tin oxide (ITO) and indium zinc oxide (IZO).

The light blocking display device may further include an attitude sensor for sensing an oblique angle of a display screen. The light blocking display device may The light blocking display device may further include a backlight unit which is provided on any one of the first surface and the second surface of the barrier layer and emits light to display an image. The backlight unit may include a lamp which emits the light and a light guide plate which converts the light emitted from the lamp into surface light. The light blocking display device may further include a condenser lens array which condenses the light emitted from the backlight unit to the respective driving holes.

The pixel electrode and the common electrode may be formed in a stripe shape and the pixel electrode and the common electrode may cross each other.

The gray may be displayed by controlling a period of time when each of the driving bodies blocks each of the driving holes. The period of time when each of the driving bodies blocks each of the driving holes may be controlled by intermittently and repeatedly applying the voltage across the pixel electrode and the common electrode.

The gray may be displayed by varying a voltage applied across the pixel electrode and the common electrode to control the positions of the driving bodies in the driving holes.

The driving holes may be in a vacuum state.

The light blocking display device may further include a surface light source which is provided on any one of the first surface and the second surface of the barrier layer and emits light to display an image.

According to an aspect of the present invention, there is provided a light blocking display device of an electric field driving type, including a barrier layer including a plurality of driving grooves and having a first surface and a second surface; driving bodies which are inserted into the driving holes and have charges; a pixel electrode formed on the first surface of the barrier layer; and a common electrode formed on the second surface of the barrier layer, wherein the area of a cross section parallel to the first and second surfaces of the driving holes is gradually changed from the first surface to the second surface.

Advantageous Effects

According to the present invention, it is possible to accomplish desired display by controlling the positions of the driving bodies using gravity and an electrical force to control the amount of light.

BRIEF DESCRIPTION OF THE DRAWINGS

The above and other features and advantages of the present invention will become more apparent by describing in detail exemplary embodiments thereof with reference to the attached drawings in which:

FIG. 1 is a cross-sectional view of a light blocking display device of an electric field driving type according to an embodiment of the present invention;

FIG. 2 is a partial enlarged view of FIG. 1;

FIG. 3 is a cross-sectional view of a display panel of a light blocking display device of an electric field driving type according to another embodiment of the present invention;

FIGS. 4 and 5 show a method of controlling a driving electric field according to an oblique angle of the light blocking display device of the electric field driving type; and FIGS. 6 to 10 are cross-sectional views of light blocking display devices of an electric field driving type according to the other embodiments of the present invention.

MODE FOR THE INVENTION

Hereinafter, exemplary embodiments of the present invention will be described in detail with reference to the attached drawings such that the present invention can be easily put into practice by those skilled in the art.

In the drawings, thickness are enlarged for the purpose of clearly illustrating layers and areas. In addition, like elements are denoted by like reference numerals in the whole specification. If it is mentioned that a layer, a film, an area, or a plate is placed on a different element, it includes a case that the layers, film, area, or plate is placed right on the different element, as well as a case that another element is disposed therebetween. On the contrary, if it is mentioned that one element is placed right on another element, it means that no element is disposed therebetween.

FIG. 1 is a cross-sectional view of a light blocking display device of an electric field driving type according to an embodiment of the present invention, and FIG. 2 is a partial enlarged view of FIG. 1.

Referring to FIG. 1, the light blocking display device according to the present embodiment includes a display panel 100 and a backlight unit 300. The display panel 100 controls the amount of light to display an image, and includes a plurality of driving holes 151 and driving bodies 101 inserted in the driving holes 151 and having charges. The backlight unit 300 emits light to the display panel 100, and includes a lamp 302 for emitting the light, a light guide plate 301 for converting the light emitted from the lamp 302, which is a point light source or a line light source, into surface light, and a condenser lens 303 for condensing the light emitted from the light guide plate 301 and transmitting the light to a driving holes 151 of the display panel 302. Here, the lamp 302 may be the line light source such as a cold cathode fluorescent lamp (CCFL) or an external electrode fluorescent lamp (EEFL) or the point light source such as a light emitting diode (LED). Alternatively, the lamp 302 may be a surface light source, and in this case, the light guide plate 301 may be omitted. The condenser lens 303 may be directly formed on the light guide plate 301 as a mono layer or a separate film shape. Alternatively, the condenser lens 303 may be formed at a side of the display panel 100 by one layer.

In the light blocking display device, an electric force is applied to the driving bodies 101 in the driving holes 151 to move the driving body 101 and to control passage of the light emitted from the backlight unit 300, thereby displaying a desired image.

The display panel 100 of the light blocking display device will be described in detail with reference to FIG. 2.

A plurality of pixel electrodes 120 is formed on one surface of a transparent insulating substrate 110 made of glass. Here, the pixel electrode 120 is made of transparent conductive material such as indium tin oxide (ITO) or indium zinc oxide (IZO) and uniformly arranged in a matrix.

Switching elements 130 for separately switching voltages applied to the pixel electrodes 120 are formed on the insulating substrate 110 and connected to the pixel electrodes 120. Here, the switching element 130 may be a thin film transistor. The switching elements 130 are formed on the insulating substrate 110 such that gate lines (not illustrated) for transmitting scan signals for turning on/off the thin film transistors and data lines (not illustrated) for transmitting gray voltages applied to the pixel electrodes 120 cross each other.

A first insulating layer 140 is formed on the pixel electrodes 120 and the switching elements 130. Here, the first insulating layer 140 is made of an inorganic insulating material such as silicon nitride $SiN_x$ or silicon oxide $SiO_2$ or an organic insulating material such resin. Alternatively, the first insulating layer 140 may be formed below the switching elements 130.

On the first insulating layer 140, a barrier layer 150 having a plurality of driving holes 151 is formed. The barrier layer 150 may be made of a light-permeable material or an opaque material through which light cannot pass. The barrier layer 150 is preferably made of a black material to prevent display quality from deteriorating due to permeation or reflection of unnecessary light. The barrier layer 150 may be formed by exposing and developing a photosensitive layer containing black pigment using a specific mask or a nano printing method. Alternatively, the barrier layer 150 may be formed by exposing and developing the photosensitive layer as the mask and performing a post-process for blocking the light. The area of a cross section of the driving hole 151 parallel to a surface of the barrier layer (or a surface of the insulating substrate 110) is gradually changed from a lower surface to an upper surface of the barrier layer 150. In FIG. 2, the area of the cross section of the driving hole 151 gradually increases while the area is changed from the lower surface to the upper surface of the barrier layer 150. In contrast, the area of the cross section of the driving hole 151 may gradually decrease while the area is changed from the lower surface to the upper surface of the barrier layer 150. In the present embodiment, the driving hole 151 has a truncated cone shape. Furthermore, the driving hole 151 may have various shapes.

An inactive gas such as argon, neon, or helium is filled in the driving hole 151 of the barrier layer 150. In addition, the driving body 101 is inserted in the driving hole 151 of the barrier layer 150. Here, the driving body 101 is made of an opaque material, and the surface of the driving body 101 is black to prevent the light from being reflected and has predetermined charges. The charge may be negative or positive charge. Instead of the inactive gas, the other gas suitable for holding charges on the driving body 101, such as nitrogen or dried air, may be filled in the driving hole 151. Alternatively, the driving hole 151 may be in a vacuum state. Although, in the present embodiment, the driving body 101 has a spherical shape, the driving body 101 may have a different shape such as a cylindrical shape, depending on the shape of the driving hole 151. The area of a cross section passing through a center of the driving body 101 (hereinafter, referred to as central cross section) is preferably greater than a smallest area of the cross section of the driving hole 151, in order to completely block the driving hole 151 to realize a complete black state. A cavity may be formed in the driving body 101 so as to reduce the weight of the driving body 101.

A second insulating layer 210 is formed on the barrier layer 151. The second insulating layer 210 may be formed in a film shape. The second insulating layer 210 may be made of silicon nitride or silicon oxide.

A common electrode 220 made of a transparent conductive material such as ITO or IZO is formed on the second insulating layer 210.

A light shielding layer 230 for defining a pixel region is formed on the common electrode 220. The light shielding layer 230 prevents the light emitted from adjacent pixels from being mixed with each other. When the barrier layer 150 can function as the light shielding layer, the light shielding layer 230 may be omitted.

Color filters of red, green, and blue 240R, 240G, and 240B are formed on the light shielding layer 230. The color filters 240R, 240G, and 240B are arranged at positions corresponding to the respective driving holes 151.

In the display panel 100, the backlight unit 300 may be provided at a side of the insulating substrate 110 or the color filters 240R, 240G, and 24B, Driving of the light blocking display device of the electric field driving type will be described.

In general, the display device is used in the state that a display screen is standing in a vertical upright position. Accordingly, the inner surface of the driving hole 151 in the barrier layer 150 forms an oblique surface. The driving body 101 rolls downward on the oblique surface by gravity. However, when a voltage is applied across the pixel electrode 120 and the common electrode 220, an electric field is generated and the driving body having charges receives an electric force and rolls upward on the oblique surface against the gravity. Accordingly, by controlling the voltage across the pixel electrode 120 and the common electrode 220, the electric force applied to the driving body 101 can be controlled and thus the position of the driving body 101 is also controllable. In this embodiment, the angle of the oblique surface of the driving hole 151 is constant. Alternatively, the angle of the oblique surface of the driving hole 151 may gradually increase upward, that is, the driving hole 151 may have a trumpet shape.

Since the area of the pixel electrode 120 is smaller than that of the common electrode 220, the intensity of the electric field generated between the electrodes 120 and 220 becomes gradually stronger toward the pixel electrode 120. In this case, the voltage across the electrodes 120 and 220 is controlled such that the driving body 101 stops at a predetermined point in the driving hole 151.

The area of the driving hole 151 for passing the light varies depending on the position of the driving body 101. In particular, the higher the position of the driving body 101, the narrower the area of the driving hole 151 for passing the light. When the driving body 101 is located at a lowermost side of the oblique surface, the area of the driving hole 151 for passing the light becomes a maximum. When the driving body 101 is located at an uppermost side of the oblique surface to completely block the driving hole 151, the light is completely blocked. Accordingly, by controlling the voltage across the pixel electrode 120 and the common electrode 220, it is possible to control the passage of the light.

Although the amount of the light is controlled by controlling the position of the driving body 101 in the driving hole 151, the amount of the light may be controlled by controlling a period of time when the driving body 101 blocks the light. Hereinafter, this method will be described.

When a period of time for one pixel to continuously display specific image information corresponds to one frame, the amount of the light can be controlled by varying the period of time when the driving body 101 blocks the driving hole 151 in one frame. For example, when the voltage is not continuously applied in one frame such that the driving body 101 is located at the lowermost side of the oblique surface, a white state which is a highest gradation is displayed, whereas when the voltage is lastingly applied in one frame such that the driving body 101 blocks the driving hole 151, a black state which is a lowest gray is displayed. Furthermore, when the voltage is applied such that the driving body 101 blocks the driving hole 151 during a period of time corresponding to a half of one frame, an intermediate gray is displayed. At this time, the period of time when the driving body 101 blocks the driving hole 151 can be controlled by continuously applying the voltage to the driving body 151 or by intermittently and repeatedly applying the voltage to the driving body 151 in the period of time corresponding to the gray. For example, when 156th gray is displayed using the light blocking display device which can display 256 grays, one frame is divided into 256 sections and the voltage is continuously applied in the period of time corresponding to 100 sections or application of the voltage in the period of time corresponding to one section is repeatedly performed 100 times, thereby achieving the brightness corresponding to the 156th gray.

In addition, by using the color filters 240R, 240G, 240B, an image is displayed in color.

Here, since the size of the driving body 101 is about few micrometers and the driving body 101 can be driven by a voltage of a few tens of milivolts (mV) or a few hundreds of milivolts and operated at a high speed, it is possible to provide a display device having a high response speed and a precise adjustment function. Since the operation speed of the driving body 101 is inversely proportional to the weight of the driving body 101, a cavity may be formed in the driving body 101 in order to reduce the weight of the driving body 101.

Although the driving body 101 is driven using the gravity and the electric force, an electric force which acts in the opposite direction of the existing electric force may be used as a means for replacing or compensating the gravity. In other words, by reversing the voltage across the pixel electrode 120 and the common electrode 220, the driving body 101 can reciprocally move independent of the gravity.

FIG. 3 is a cross-sectional view of a display panel of a light blocking display device of an electric field driving type according to another embodiment of the present invention.

Referring to FIG. 3, on one surface of a first insulating substrate 110 made of a transparent material such as glass, color filters 240 of red, green, and blue are formed in a matrix.

Pixel electrodes 120 are formed on the respective color filters 240. Here, the pixel electrode 120 is made of a transparent conductive material such as ITO or IZO.

Switching elements 130 for separately switching voltages applied to the pixel electrodes 120 are formed on the insulating substrate 110 and connected to the pixel electrodes 120. Here, the switching element 130 may be a thin film transistor. The switching elements 130 are formed on the insulating substrate 110 such that gate lines (not illustrated) for transmitting scan signals for turning on/off the thin film transistors and data lines (not illustrated) for transmitting gray voltages applied to the pixel electrodes 120 cross each other.

A first insulating layer 140 is formed on the pixel electrodes 120 and the switching elements 130. Here, the first insulating layer 140 is made of an inorganic insulating material such as silicon nitride $SiN_x$ or silicon oxide $SiO_2$ or an organic insulating material such resin. Alternatively, the first insulating layer 140 may be formed below the switching elements 130.

On the first insulating layer 140, a barrier layer 150 having a plurality of driving holes 151 is formed. The barrier layer 150 is preferably black. The barrier layer 150 may be formed by exposing and developing a photosensitive layer containing black pigment using a specific mask or a nano printing method. The area of a cross section of the driving hole 151 parallel to a surface of the barrier layer (or a surface of the insulating substrate 110) is gradually changed from a lower surface to an upper surface of the barrier layer 150. In FIG. 3, the area of the cross section of the driving hole 151 gradually increases while the area is changed from the lower surface to the upper surface of the barrier layer 150. In contrast, the area of the cross section of the driving hole 151 may gradually decrease while the area is changed from the lower surface to the upper surface of the barrier layer 150. In the present embodiment, the driving hole 151 has a truncated cone shape. Furthermore, the driving hole 151 may have various shapes.

In order to prevent a failure of the driving hole 151, a plurality of driving holes 151 are formed to overlap one pixel electrode 120. By arranging a few tens of driving holes 151 on each pixel, it is possible to obtain uniform operation characteristic.

An inactive gas such as argon, neon, or helium is filled in the driving hole 151 of the barrier layer 150. Here, it is preferable that the surface of the driving body 101 is black and has predetermined charges. The charge may be negative or positive charge. Instead of the inert gas, the other gas suitable for holding charges on the driving body 101, such as nitrogen or dried air, may be filled in the driving hole 151. Alternatively, the driving hole 151 may be in a vacuum state. Although, in the present embodiment, the driving body 101 has a spherical shape, the driving body 101 may have a different shape such as a cylindrical shape, depending on the shape of the driving hole 151. The area of the central cross section is preferably greater than a smallest area of the cross section of the driving hole 151, in order to completely block the driving hole 151 to realize a complete black state. A cavity may be formed in the driving body 101 in order to reduce the weight of the driving body 101.

A second insulating layer 210 is formed on the barrier layer 151. The second insulating layer 210 may be formed in a film shape. The second insulating layer 210 may be made of silicon nitride or silicon oxide.

A common electrode 220 made of a transparent conductive material such as ITO or IZO is formed on the second insulating layer 210.

A second insulating substrate 290 is provided on the common electrode 220.

The display panel having the above-mentioned configuration can be manufactured by forming the color filters 240, the pixel electrodes 120, the switching elements 130, and the first insulating layer 140, and the barrier layer 150 on the first insulating substrate 110, forming the common electrode 220 and the second insulating layer 210 on the second insulating substrate 290, inserting the driving bodies 101 into the driving holes 151, and combining the substrates 110 and 290 with each other in an atmosphere such as inactive gas or nitrogen. Since only the common electrode 220 and the second insulating layer 210 are formed on the second insulating substrate 290, it is easy to align the substrates 110 and 290.

FIGS. 4 and 5 illustrate a method of controlling a driving electric field according to an oblique angle of the light blocking display device of the electric field driving type.

The display device is generally used in the state that the display screen is standing in a vertical upright position, but may be used in that the display screen is slightly inclined respective to a vertical plane like a notebook-type computer. In the light blocking display device according to the present invention, when the display screen is inclined respective to the vertical plane, the angle of the oblique surface of the driving hole 151 varies and thus has influence on the driving of the driving body 101 using the electric field.

As illustrated in FIG. 4, when the display panel 100 is inclined by $\theta_0$, the driving body 101 laid on the oblique surface of the driving hole 151 rolls downward on the oblique surface by a force mg $\cos(\theta_0+\theta_1)$ due to the gravity (see FIG. 5). Here, $q_1$ denotes an angle of the oblique surface of the driving hole 151. When a voltage V is applied across the pixel electrode 120 and the common electrode 220, the driving body 101 rolls upward on the oblique surface by a force $$\frac{QV\cos\theta_1}{d}$$

due to the electric force. Here, Q denotes the amount of the charges of the driving body 101 and d denotes a distance between the electrodes 120 and 220. Accordingly, in order to allow the force due to the gravity and the force due to the electric force to be in an equilibrium state, a voltage $$\text{mg}\cos(\theta_0+\theta_1) = \frac{QV\cos\theta_1}{d}$$

$$\text{V} = \frac{\text{mg}\cos(\theta_0+\theta_1)d\cos\theta_1}{Q}$$

is applied across the pixel electrode 120 and the common electrode 220. The driving voltage across the pixel electrode 120 and the common electrode 220 is calculated by a function of $\theta_0$ and $\theta_1$. Here, since $\theta_1$ is previously determined, a necessary driving voltage can be calculated by measuring $\theta_0$.

Accordingly, an attitude sensor for measuring an oblique angle is mounted in the light blocking display device according to an embodiment of the present invention, a driving voltage control unit receives the oblique angle detected by the attitude sensor, and a driving voltage corresponding to the oblique angle is applied across the pixel electrode 120 and the common electrode 220, thereby accomplishing desired display.

Although an active type light blocking display device is described in the above description, the present invention can apply to a passive type light blocking display device.

FIGS. 6 to 10 are cross-sectional views of light blocking display devices of an electric field driving type according to the other embodiments of the present invention.

First, referring to FIG. 6, a first insulating layer 140 and a second insulating layer 210 are formed on the both surfaces of the barrier layer 150 and stripe-shaped pixel and common electrodes 121 and 221 are formed on the outer surface of the insulating layers 140 and 210, respectively. Here, the longitudinal directions of the pixel electrodes 121 and the common electrodes 221 are perpendicular to each other. In the present embodiment, the driving body 101 and the barrier layer 150 are black and a light shielding layer is not required.

In the passive type display device, when voltages are applied to one of the plurality of pixel electrodes 121 and one of the plurality of common electrodes 221, respectively, the driving body 101 located at a position where the electrodes 121 and 221 cross each other is driven by an electric force.

An embodiment illustrated in FIG. 7 is different from the embodiment illustrated in FIG. 6 in that condenser lenses 303 are further formed on the common electrodes 221.

In an embodiment illustrated in FIG. 8, driving grooves 151 are formed in a barrier layer 150, a light shielding layer 230 is formed on one surface of the barrier layer 150, and common electrodes 221 are formed on the light shielding layer 230. Since the driving holes 151 do not pass through the barrier layer 150, an insulating layer for isolating the common electrodes 221 from the driving bodies 101 need not be formed. The barrier layer 150 can be easily formed using a nano printing method. Furthermore, since the light shielding layer 230 prevents the light from being mixed with each other between the driving holes 151, the barrier layer 150 may be made of a light-permeable material.

An embodiment illustrated in FIG. 9 is different from the embodiment illustrated in FIG. 8 in that the driving holes 151 pass through the barrier layer 150 and the light shielding groove 230 and a second insulating layer 210 for isolating the common electrodes 221 from the driving bodies 101 is formed.

An embodiment illustrated in FIG. 10 is different from the embodiment illustrated in FIG. 9 in that the light shielding layer 230 is formed on an outer surface of the common electrodes 221.

As mentioned above, according to the present invention, it is possible to accomplish desired display by controlling the positions of the driving bodies using gravity and an electrical force to control the amount of light.

Although the exemplary embodiments and the modified examples of the present invention have been described, the present invention is not limited to the embodiments and examples, but may be modified in various forms without departing from the scope of the appended claims, the detailed description, and the accompanying drawings of the present invention. Therefore, it is natural that such modifications belong to the scope of the present invention.

The invention claimed is:

1. A light blocking display device of an electric field driving type, comprising: a barrier layer including a plurality of driving holes and having a first surface and a second surface; driving bodies which are inserted into the driving holes and have charges; a pixel electrode formed on the first surface of the barrier layer; and a common electrode formed on the second surface of the barrier layer, wherein the area of a cross section parallel to the first and second surfaces of the driving holes is gradually changed from the first surface to the second surface, wherein a single driving body is disposed within each driving hole and each of the driving holes has a truncated cone shape and the area of a cross section passing through a center of each of the driving bodies is greater than the smallest area of the cross section of each of the driving holes and wherein a voltage across the pixel electrode and common electrode is controlled such that the driving body stops at a predetermined point in the driving hole.

2. The light blocking display device of claim 1, further comprising:

a first insulating layer formed between the first surface of the barrier layer and the pixel electrode; and a second insulating layer formed between the second surface of the barrier layer and the common electrode.

3. The light blocking display device of claim 1, wherein at least one of inactive gas, nitrogen, and dried air is filled in the driving holes.

4. The light blocking display device of claim 1, wherein the pixel electrode is formed in plural, the common electrode is formed of a single electrode corresponding to all of the pixel electrodes, switching elements formed on the first surface of the barrier layer are further included, and the switching elements are connected to the respective pixel electrodes to control voltages applied to the respective pixel electrodes.

5. The light blocking display device of claim 4, wherein each of the switching elements includes a thin film transistor.

6. The light blocking display device of claim 1, wherein each of the driving bodies has a spherical shape.

7. The light blocking display device of claim 6, wherein the surface of each of the driving bodies is black.

8. The light blocking display device of claim 1, wherein each of the driving bodies has a spherical shape and the area of a cross section passing through a center of each of the driving bodies is greater than the cross section of each of the driving holes.

9. The light blocking display device of claim 1, wherein the barrier layer is black.

10. The light blocking display device of claim 9, wherein the barrier layer is formed by exposing and developing a photosensitive layer containing black pigment using a mask.

11. The light blocking display device of claim 1, further comprising a light shielding layer formed on any one of the first surface and the second surface of the barrier layer.

12. The light blocking display device of claim 1, further comprising an insulating substrate provided on at least one of an outer surface of the pixel electrode and an outer surface of the common electrode.

13. The light blocking display device of claim 12, wherein the insulating substrate comprises a first insulating substrate provided on the outer surface of the pixel electrode and a second substrate provided on the outer surface of the common electrode.

14. The light blocking display device of claim 1, wherein the pixel electrode overlaps with the plurality of driving holes.

15. The light blocking display device of claim 1, wherein the area of the cross section parallel to the first and second surfaces of the barrier layer gradually increases while the area changes from the first surface to the second surface.

16. The light blocking display device of claim 1, wherein the area of the cross section parallel to the first and second surfaces of the barrier layers gradually decreases while the area changes from the first surface to the second surface.

17. The light blocking display device of claim 1, further comprising a color filter formed on one of an outer surface of the pixel electrode and an outer surface of the common electrode.

18. The light blocking display device of claim 17, further comprising an insulating substrate provided on the outer surface of the pixel electrode, wherein the color filter is disposed between the pixel electrode and the insulating substrate.

19. The light blocking display device of claim 1, wherein the pixel electrode and the common electrode are made of a transparent conductive material.

20. The light blocking display device of claim 19, wherein the pixel electrode and the common electrode are made of indium tin oxide (ITO) or indium zinc oxide (IZO).

21. The light blocking display device of claim 1, further comprising an attitude sensor for sensing an oblique angle of a display screen.

22. The light blocking display device of claim 21, further comprising a driving voltage control unit which controls a gray voltage applied across the common electrode and the pixel electrode according to the oblique angle sensed by the attitude sensor.

23. The light blocking display device of claim 1, further comprising a backlight unit which is provided on any one of the first surface and the second surface of the barrier layer and emits light for display.

24. The light blocking display device of claim 23, wherein the backlight unit comprises a lamp which emits the light and a light guide plate which converts the light emitted from the lamp into surface light.

25. The light blocking display device of claim 24, further comprising a condenser lens array which condenses the light emitted from the backlight unit to the respective driving holes.

26. The light blocking display device of claim 1, wherein the pixel electrode and the common electrode are formed in a stripe shape and the pixel electrode and the common electrode cross each other.

27. The light blocking display device of claim 1, wherein a gray is displayed by controlling a period of time when each of the driving bodies blocks each of the driving holes.

28. The light blocking display device of claim 27, wherein the period of time when each of the driving bodies blocks each of the driving holes is controlled by intermittently and repeatedly applying the voltage across the pixel electrode and the common electrode.

29. The light blocking display device of claim 1, wherein a gray is displayed by varying a voltage applied across the pixel electrode and the common electrode to control the positions of the driving bodies in the driving holes.

30. The light blocking display device of claim 1, wherein the driving holes are in a vacuum state.

31. The light blocking display device of claim 1, further comprising a surface light source which is provided on any one of the first surface and the second surface of the barrier layer and emits light for display.

32. A light blocking display device of an electric field driving type, comprising: a barrier rib including a plurality of driving holes and having a first surface and a second surface; driving bodies which are inserted into the driving holes and have charges; a pixel electrode formed on the first surface of the barrier rib; and a common electrode formed on the second surface of the barrier rib, wherein the area of a cross section parallel to the first and second surfaces of the driving holes is gradually changed from the first surface to the second surface, wherein a single driving body is disposed within each driving hole and each of the driving holes has a truncated cone shape and the area of a cross section passing through a center of each of the driving bodies is greater than the smallest area of the cross section of each of the driving holes and wherein a voltage across the pixel electrode and common electrode is controlled such that the driving body stops at a predetermined point in the driving hole.

* * * * *